US009763850B2

(12) United States Patent
Cheng

(10) Patent No.: US 9,763,850 B2
(45) Date of Patent: Sep. 19, 2017

(54) INTERLOCKING FITNESS ROLLER

(71) Applicant: Cheng-Kuo Cheng, Tainan (TW)

(72) Inventor: Cheng-Kuo Cheng, Tainan (TW)

( * ) Notice: Subject to any disclaimer, the term of this patent is extended or adjusted under 35 U.S.C. 154(b) by 481 days.

(21) Appl. No.: 14/615,734

(22) Filed: Feb. 6, 2015

(65) Prior Publication Data

US 2016/0228323 A1 Aug. 11, 2016

(51) Int. Cl.

| | |
|---|---|
| ***A61H 15/00*** | (2006.01) |
| *A63B 23/02* | (2006.01) |
| *A63B 23/04* | (2006.01) |
| *A63B 23/00* | (2006.01) |

(52) U.S. Cl.

CPC ..... *A61H 15/0092* (2013.01); *A61H 15/00* (2013.01); *A61H 2015/0014* (2013.01); *A61H 2201/0107* (2013.01); *A61H 2201/0161* (2013.01); *A61H 2201/1284* (2013.01); *A61H 2201/164* (2013.01); *A61H 2201/1623* (2013.01); *A61H 2201/1695* (2013.01); *A63B 23/0233* (2013.01); *A63B 23/04* (2013.01); *A63B 2023/006* (2013.01)

(58) Field of Classification Search

CPC ..... A61H 7/00; A61H 7/002; A61H 7/003; A61H 7/007; A61H 2007/009; A61H 15/00; A61H 15/0092; A61H 2015/0007; A61H 2015/0014; A61H 2015/0042; A61H 2201/00; A61H 2201/0107; A61H 2201/0157; A61H 2201/0161; A61H 2201/1685; Y10T 403/55; Y10T 403/557; Y10T 403/559; Y10T 403/5741

USPC ..... 601/118–122, 128–129

See application file for complete search history.

(56) References Cited

U.S. PATENT DOCUMENTS

| | | | | |
|---|---|---|---|---|
| 4,557,467 | A * | 12/1985 | Lin | E04F 11/1836 256/1 |
| 4,691,818 | A * | 9/1987 | Weber | B65G 33/32 198/666 |
| 5,123,406 | A * | 6/1992 | Masuda | A61H 15/0092 601/120 |
| 2002/0061171 | A1* | 5/2002 | Asada | G02B 6/3878 385/60 |

(Continued)

FOREIGN PATENT DOCUMENTS

| | | |
|---|---|---|
| TW | M424966 U1 | 3/2012 |

*Primary Examiner* — Justine Yu
*Assistant Examiner* — Colin W Stuart
(74) *Attorney, Agent, or Firm* — Rosenberg, Klein & Lee

(57) ABSTRACT

An interlocking fitness roller is disclosed. The ends of a column-shaped roller body comprise retaining holes and locating holes. A hollow cylindrical assembly is inserted into a hollow interior of the column-shaped roller body. The hollow cylindrical assembly connects with elastic pieces, and each elastic piece comprises a retaining block and a positioning pin, which are respectively engaged with the retaining hole and the locating hole of the column-shaped roller body. The surface of the column-shaped roller body is covered by a pad. Accordingly, depending on different uses, the length of the interlocking fitness roller is adjustable. Two column-shaped roller bodies are connected by respectively engaging the retaining blocks and the positioning pins of the elastic pieces with the retaining holes and the locating holes, so as to is prevent the connection from becoming loose during rolling, thereby ensuring the robustness of the connection between the column-shaped roller bodies.

10 Claims, 8 Drawing Sheets

(56) References Cited

U.S. PATENT DOCUMENTS

| | | | | |
|---|---|---|---|---|
| 2014/0182642 | A1* | 7/2014 | Basham | A45B 9/00 135/82 |
| 2015/0005146 | A1* | 1/2015 | Chen | A63B 21/00047 482/142 |
| 2015/0245977 | A1* | 9/2015 | Sungarian | A61H 15/00 601/118 |

* cited by examiner

INTERLOCKING FITNESS ROLLER

BACKGROUND OF THE INVENTION

Field of the Invention

The present invention relates an interlocking fitness roller. More particularly, an interlocking fitness roller comprises two roller bodies, which are connected together by an engagement structure so as to be length adjustable.

Description of Related Art

Please refer to the Taiwan Patent application with the Issue No. M424966, "COMBINED FITNESS ROLLER", which comprises a hollow column-shaped body, a connect assembly, and a pad covering the surface of the hollow column-shaped body. The internal periphery of at least one end of the hollow column-shaped body comprises an internal thread, and the external periphery of the both ends of the connect assembly comprises an external thread respectively corresponding to the internal thread, thereby screwing the external threads on the both ends of the connect assembly onto the internal threads of the hollow column-shaped bodies respectively. Because the column-shaped body is connected with the connect assembly through the thread structure, the threading connection between the column-shaped body and the connect assembly becomes loose easily during rolling the fitness roller, affecting the robustness of the connection.

SUMMARY OF THE INVENTION

Therefore, the object of the present invention is to provide an interlocking fitness roller comprising two roller bodies, which are connected together by an engagement structure so as to be length adjustable.

For the above object, an interlocking fitness roller is disclosed, comprising a column-shaped roller body, a hollow cylindrical assembly, and a pad. The column-shaped roller body comprises a hollow interior, several retaining holes at least located at one end of the column-shaped roller body, and at least one locating hole close to the retaining holes. The hollow cylindrical assembly is inserted into the hollow interior of the column-shaped roller body and connected with several elastic pieces. One end of each elastic piece is connected with the hollow cylindrical assembly and the other end of each elastic piece is connected with a handle part. Each elastic piece comprises a retaining block and at least one positioning pin. The retaining block is located at one end of the elastic piece and engaged with one of the retaining holes on the column-shaped roller body. The positioning pin is located at the other end of the elastic piece and engaged with the locating hole on the column-shaped roller body. The pad covers the surface of the column-shaped roller body.

DETAILED DESCRIPTION OF THE PREFERRED EMBODIMENT

Figure 1:
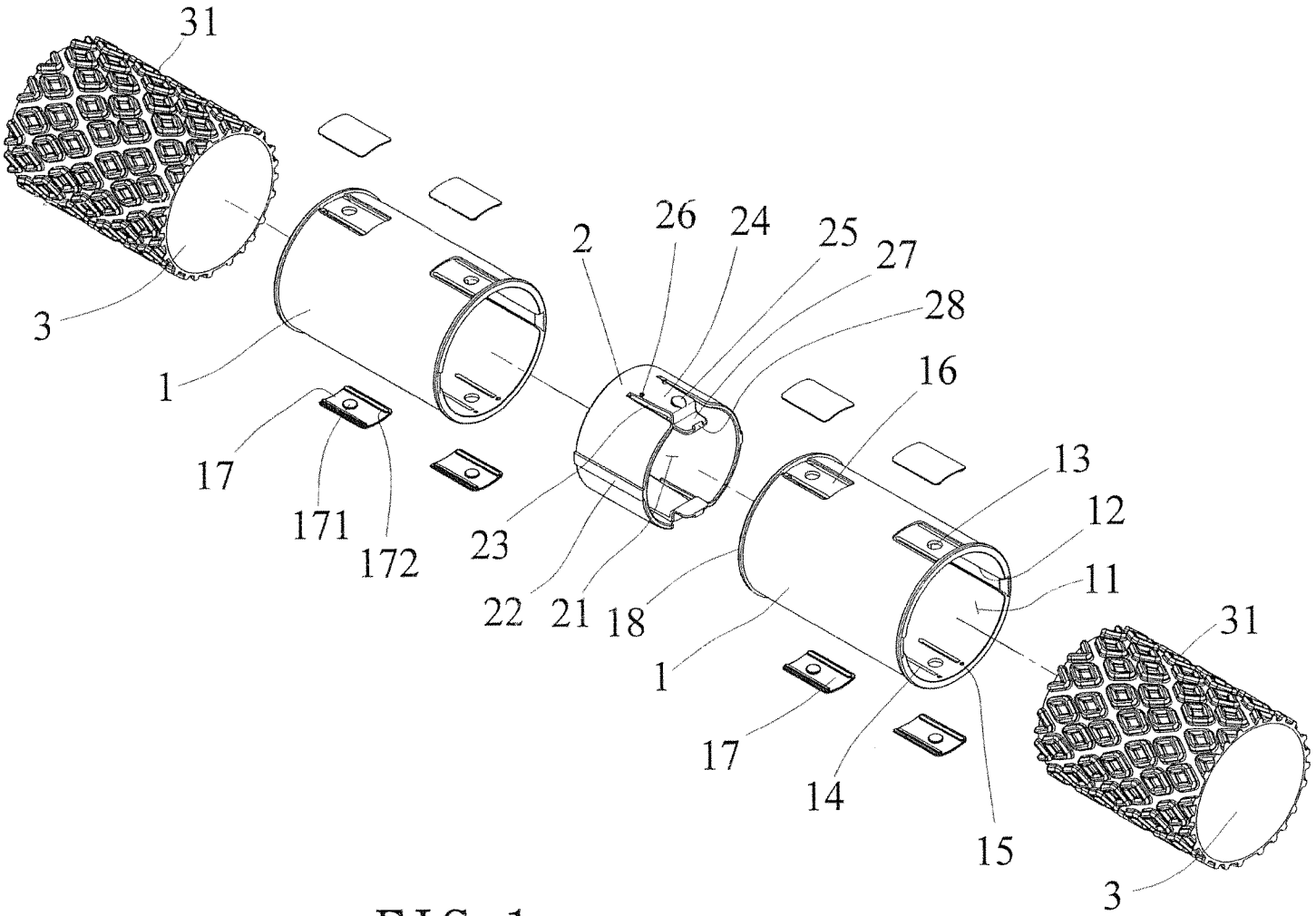
FIG. 1 is an explode view of an interlocking fitness roller according to the embodiment of the present invention.

First, please refer to FIG. 1, which is an explode view of an interlocking fitness roller according to the embodiment of the present invention. The interlocking fitness roller comprises two column-shaped roller bodies 1, a hollow cylindrical assembly 2, and two pads 3.

The roller body 1 is integrally made of rigid plastic by injection molding and is formed as hollow column-shaped. Several sliding chutes 12 are formed and axially located on the wall of a hollow interior 11 of the column-shaped roller body 1, and several retaining holes 13 are formed and at least located at one end of the column-shaped roller body 1. According to one embodiment, the retaining holes 13 are located at the both ends of the column-shaped roller body 1. At least one guiding slot 14 is formed next to one of the retaining holes 13 on the column-shaped roller body 1. According to one embodiment, the both sides of one of the retaining holes 13 both have one guiding slot 14. At least one locating hole 15 is formed adjacent to the end of the column-shaped roller body 1 and corresponded with the guiding slot 14. According to one embodiment, two locating holes 15 are corresponded with two guiding slots 14 respectively. The external wall of the column-shaped roller body 1 comprises a dented part 16, in which the retaining hole 13, the guide slots 14 and the locating holes 15 are located, and the interlocking fitness roller comprises a cover 17 for covering the dented part 16. The bottom of the cover 17 comprises a bump 171 and two ribs 172 respectively located at the both sides of the bump 171, thereby the bump 171 covering the retaining hole 13 and the ribs 172 covering the guide slots 14 and the locating holes 15 which are located at the both sides of the retaining hole 13. The both ends of the column-shaped roller body 1 comprise a retaining lip 18 respectively.

The hollow cylindrical assembly 2 is integrally made of rigid plastic by injection molding and comprises a hollow interior 21. The hollow cylindrical assembly 2 is inserted into the hollow interior 11 of the column-shaped roller body 1. Several sliders 22 are axially formed and located on the external wall of the hollow cylindrical assembly 2 and corresponded with the sliding chutes 12 of the column-shaped roller body 1. Two trenches 23 are formed and axially extend from one end of the hollow cylindrical assembly 2 to an optional site, so that an elastic piece 24 is formed between the two trenches 23 and only one end of the elastic piece 24 is connected with the hollow cylindrical assembly 2. According to the embodiment, the hollow cylindrical assembly 2 comprises several elastic pieces 24. Each elastic piece comprises a retaining block 25 and at least one positioning pin 26 adjacent to the retaining block 25. According to one embodiment, the both sides of the retaining block 25 both have one positioning pin 26. Furthermore, the retaining block 25 is located at the one end of the elastic piece 24, so that the retaining block 25 is engaged with one of the retaining holes 13 on the column-shaped roller body 1; and the positioning pin 26 is located at the other end of the elastic piece 24, so that the positioning pin 26 is through the guide slot 14 of the column-shaped roller body 1 and engaged with the locating hole 15. A handle part 27 is formed at the end of the elastic piece 24 and is opposite the connection with the hollow cylindrical assembly 2. In detail, the handle part 27 is radially extended to the hollow interior 21 of the hollow cylindrical assembly 2 and continuously axially extended to the outside of the hollow cylindrical assembly 2. An abutting block 28 is formed on the handle part 27 and is opposite the connection with the elastic piece 24. In detail, the abutting block 28 is radially extended to the outside of the elastic piece 24. The retaining block 25 has a chamfer formed at the end adjacent to the handle part 27.

The pad 3 is made from one of the soft materials, such as Thermo-Plastic-Rubber material (TPR) or Ethylene Vinyl Acetate (EVA) and covers the surface of the column-shaped roller body 1. The both ends of the pad 3 respectively abut the retaining lip 18 on the both ends of the column-shaped roller body 1. Furthermore, the surface of the pad 3 has a texture pattern 31.

Figure 2:
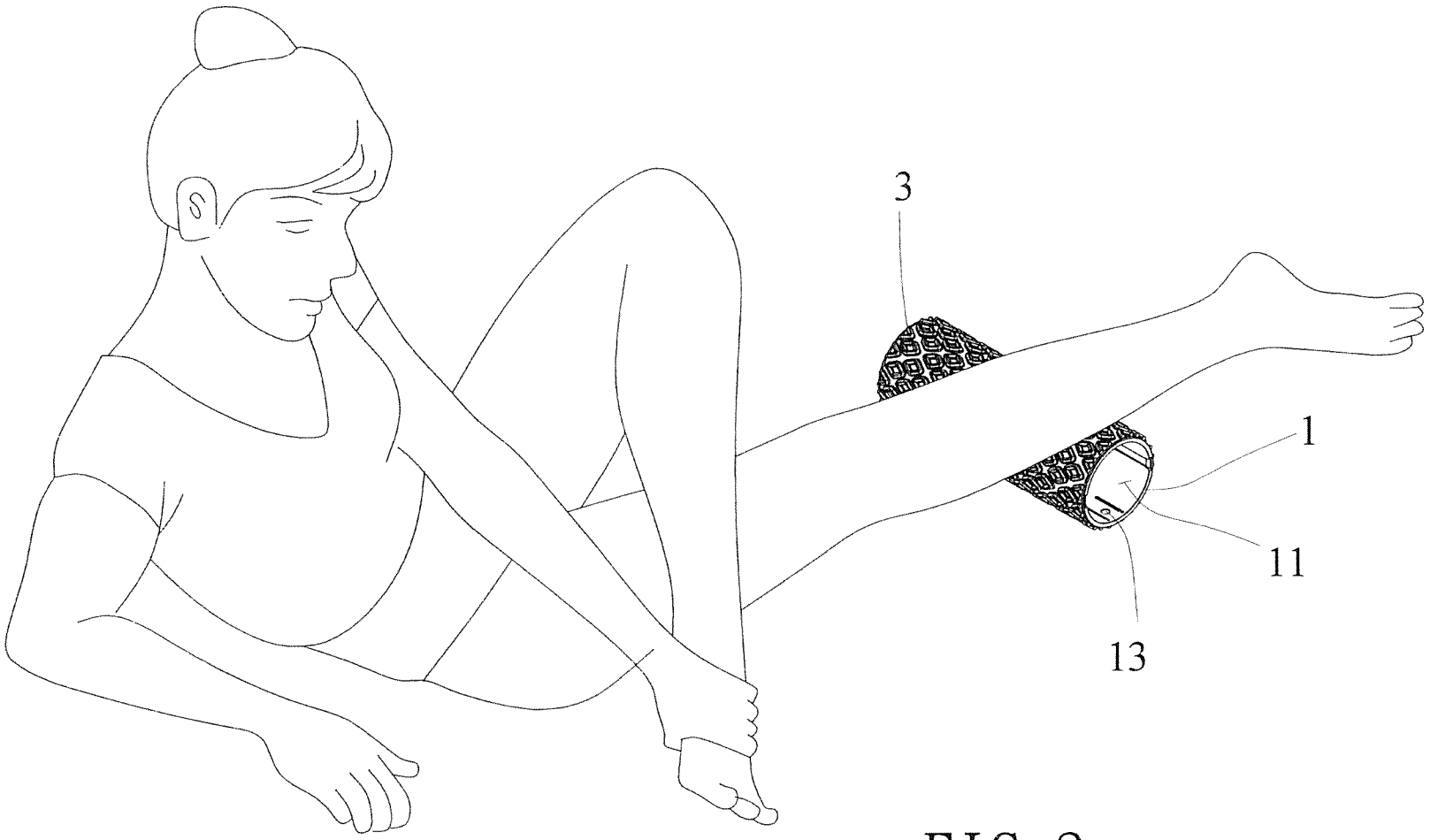
FIG. 2 is a perspective view of an interlocking fitness roller when it is used according to the embodiment of the present invention.
Figure 3:
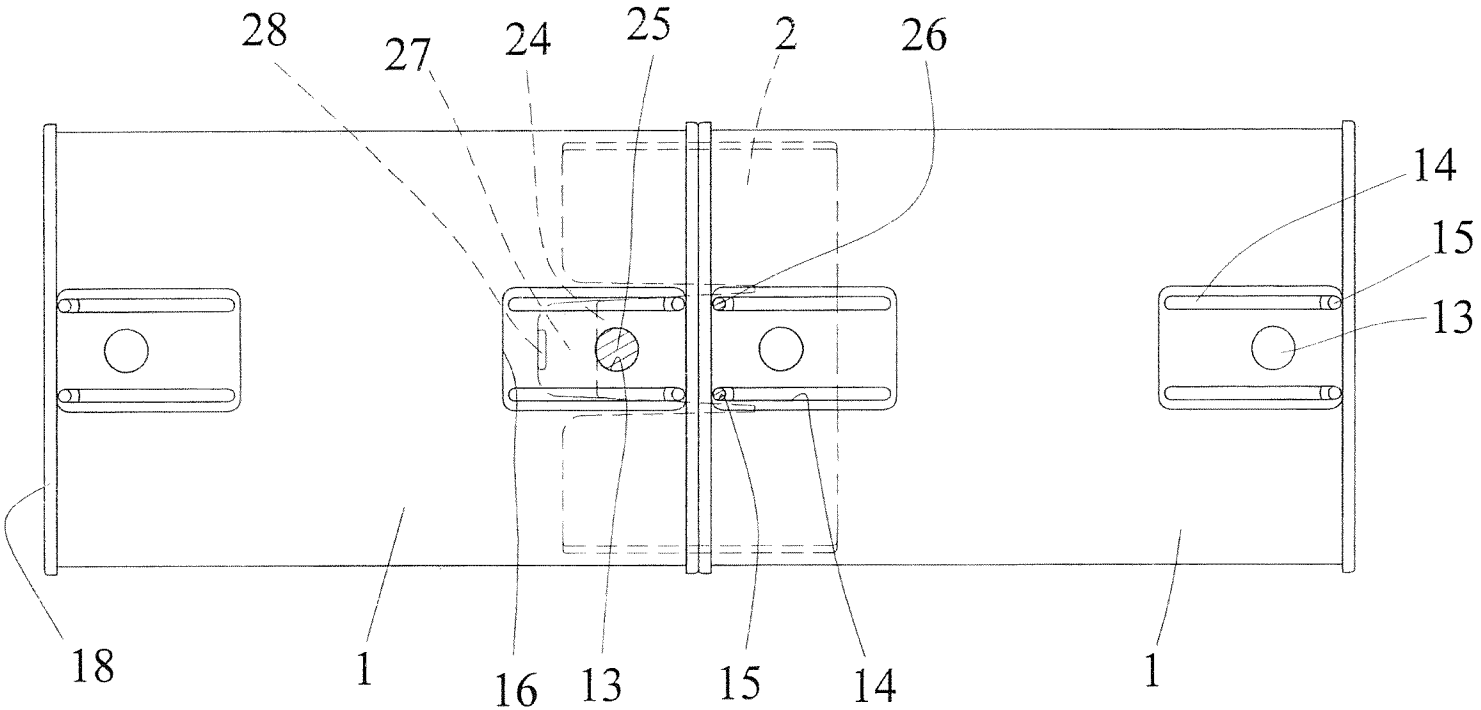
FIG. 3 is a top view of an interlocking fitness roller according to the embodiment of the present invention.
Figure 4:
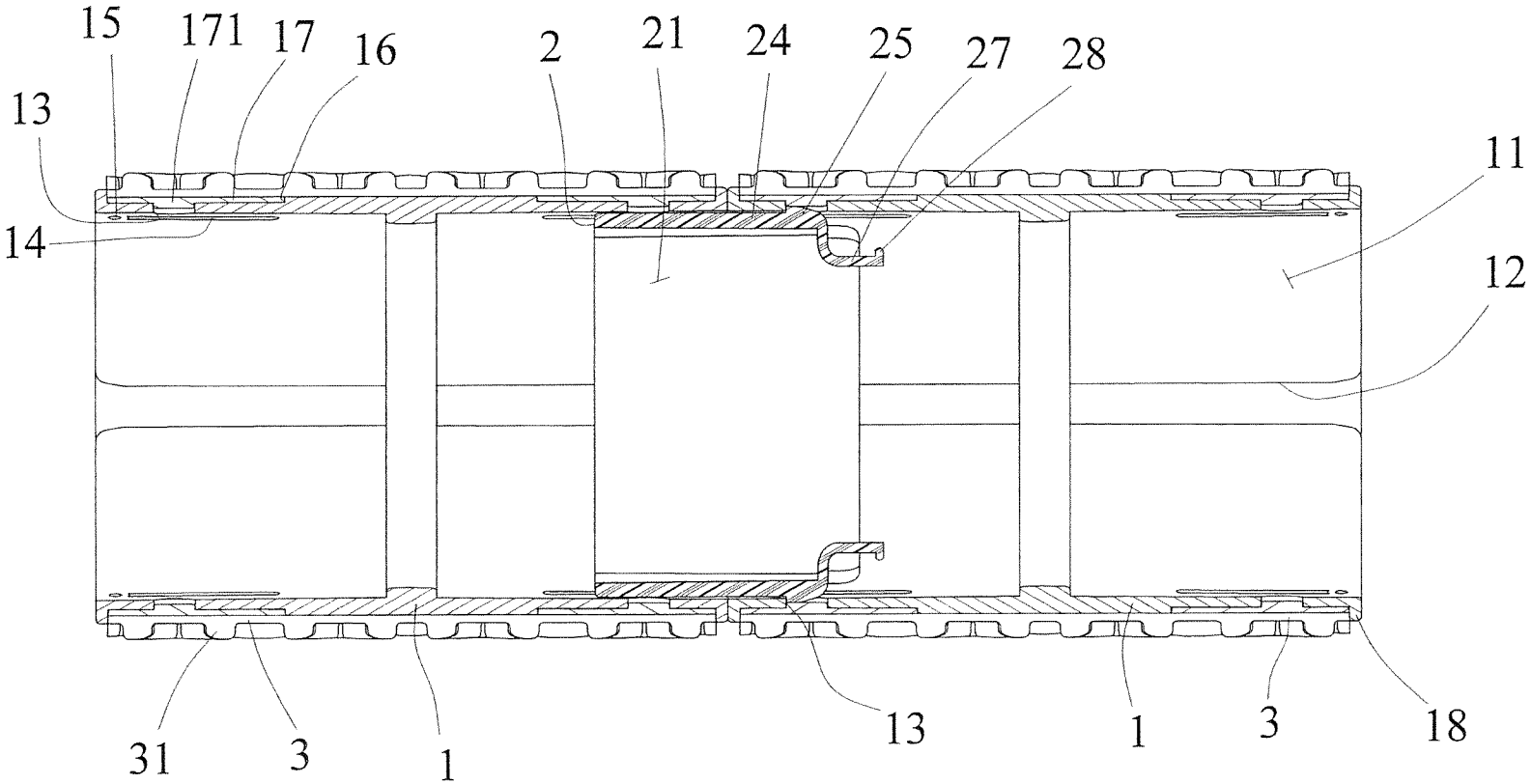
FIG. 4 is a sectional view of an interlocking fitness roller according to the embodiment of the present invention.
Figure 5:
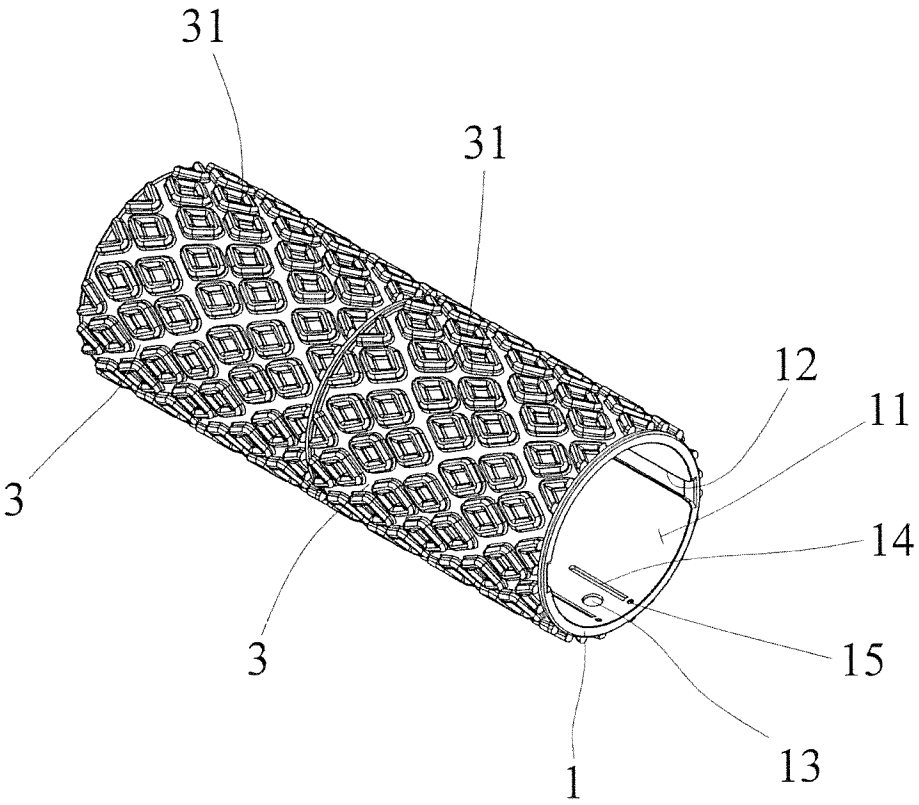
FIG. 5 is a three-dimensional view of an interlocking fitness roller according to the embodiment of the present invention.

Please refer to FIG. 2, which is a perspective view of an interlocking fitness roller when it is used according to the embodiment of the present invention. When the interlocking fitness roller of the present invention is used, the leg of the user is lain on the interlocking fitness roller, comprising one column-shaped roller body 1 covered by the pad 3, and slides backwards and forwards on the interlocking fitness roller to drive the interlocking fitness roller rolling to stretch and massage the muscles and bones of the user's body. Please refer to FIG. 3 and FIG. 4, which are a top view and a sectional view of an interlocking fitness roller according to the embodiment of the present invention respectively. When the length of the interlocking fitness roller needs to be adjustable due to different requirements, the sliders 22 of a first hollow cylindrical assembly 2 are engaged with the sliding chutes 12 located on the wall of the hollow interior 11 of a first column-shaped roller body 1, which the first column-shaped roller body 1 is covered by the pad 3, thereby inserting the first hollow cylindrical assembly 2 into the hollow interior 11 of the first column-shaped roller body 1. And then, the positioning pin 26 on the one end of the elastic piece 24 of the first hollow cylindrical assembly 2 is engaged with one of the locating holes 15 of the first column-shaped roller body 1 to connect the first hollow cylindrical assembly 2 with the first column-shaped roller body 1. At this time, the other end, which comprises the retaining block 25, of the elastic piece 24 of the first hollow cylindrical assembly 2 is exposed to the outside of the first column-shaped roller body 1. Next, the hollow interior of a second column-shaped roller body 1 covered by the pad 3 is connected with the exposed end of the first hollow cylindrical assembly 2 so as to engage the retaining block 25 on the elastic piece 24 of the first hollow cylindrical assembly 2 with the retaining hole 13 of the second column-shaped roller body 1. Therefore, the first column-shaped roller body 1 is connected with one end of the second column-shaped roller body 1, shown as FIG. 5.

When the length of the interlocking fitness roller is further elongated, according to the foregoing assembly method, a second hollow cylindrical assembly 2 is connected with the other end of the second column-shaped roller body 1. In detail, the positioning pin 26 on the second hollow cylindrical assembly 2 is engaged with the locating hole 15 on the other end of the second column-shaped roller body 1, and then one end of a third column-shaped roller body 1 covered by the pad 3 is connected with the second hollow cylindrical assembly 2 so as to engage the retaining block 25 of the second hollow cylindrical assembly 2 with the retaining hole 13 of the third column-shaped roller body 1, thereby connecting the third column-shaped roller body 1 together. When the length of the interlocking fitness roller is desired, the lumbar or the back of the user is lain on the interlocking fitness roller to massage the lumbar or the back by the interlocking fitness roller. In the interlocking fitness roller of the present invention, because the retaining block 25 and the positioning pin 26 on the elastic piece 24 of the hollow cylindrical assembly 2 are engaged with the retaining hole 13 and the locating hole 15 of the two column-shaped roller bodies 1 respectively to connect two column-shaped roller bodies 1 together, no matter how rolling the interlocking fitness roller of the present invention, the connection between the two column-shaped roller bodies 1 does not loose, thereby ensuring its robustness.

Figure 6:
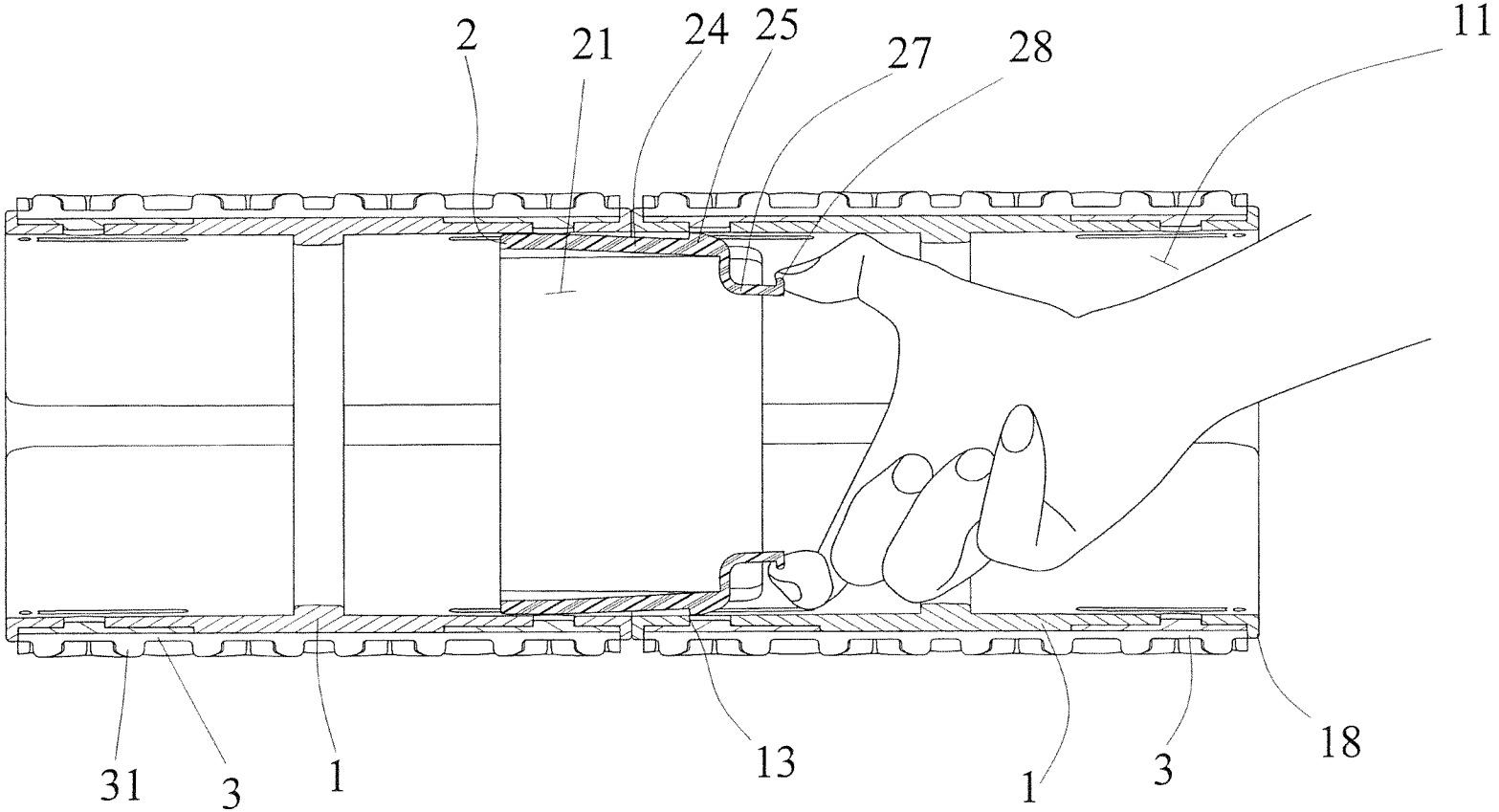
FIG. 6 is a sectional view of an interlocking fitness roller when a user disassembles it according to the embodiment of the present invention.
Figure 7:
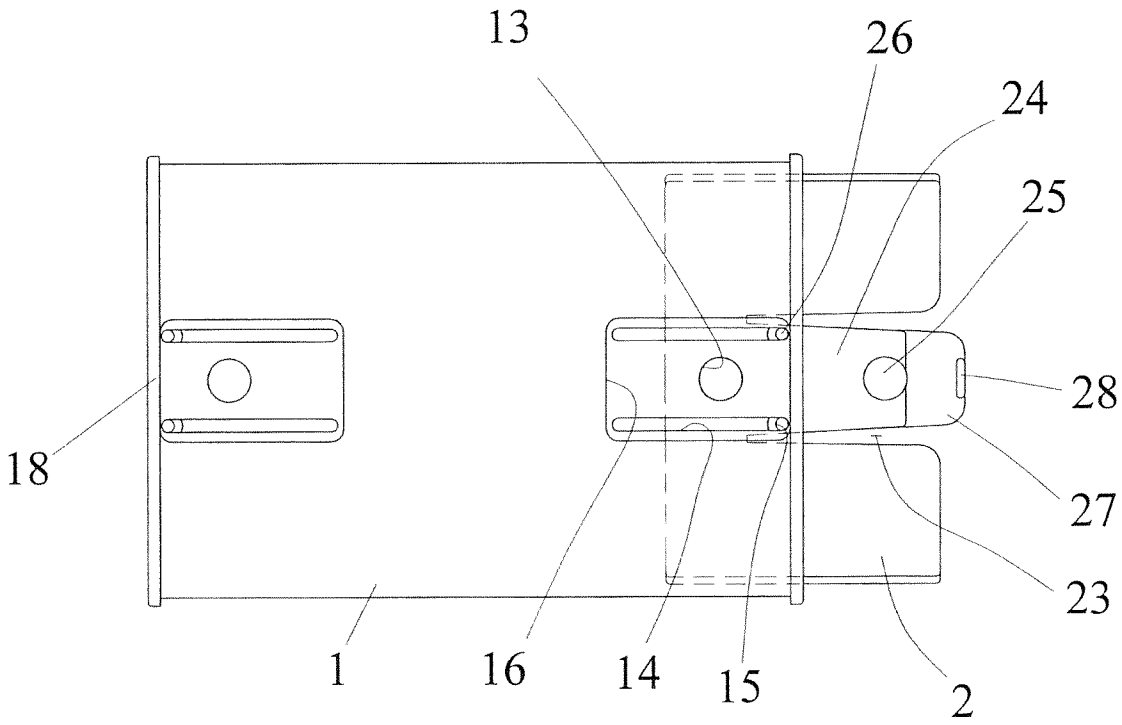
FIG. 7 is a top view of an interlocking fitness roller when a hollow cylindrical assembly is being stored according to the embodiment of the present invention.
Figure 8:
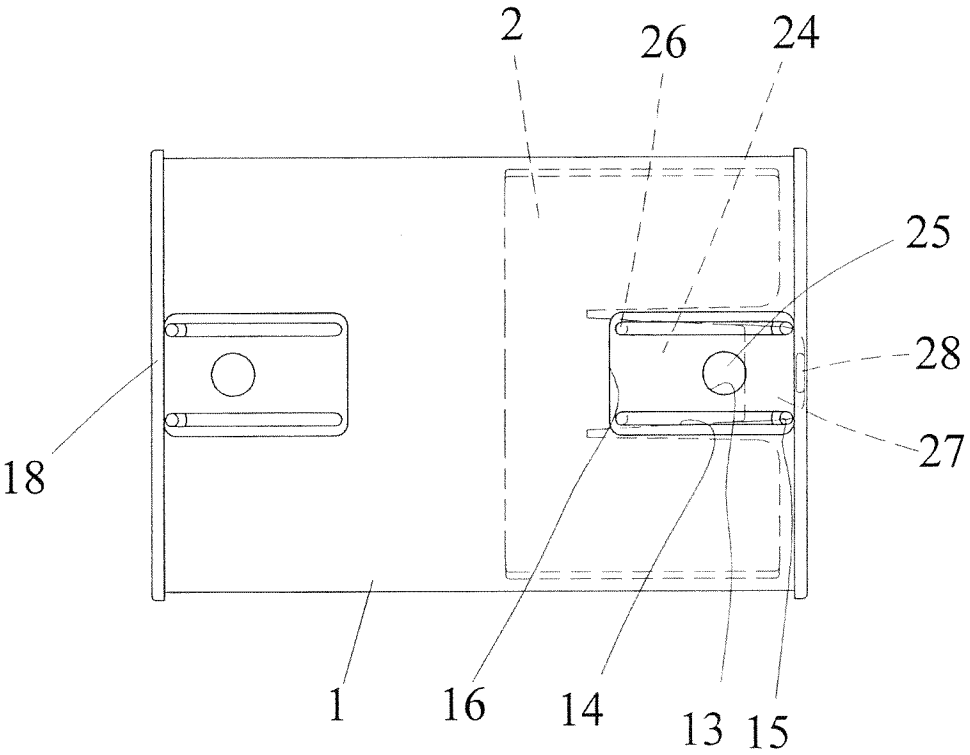
FIG. 8 is a top view of an interlocking fitness roller after a hollow cylindrical assembly has been stored according to the embodiment of the present invention.

Please refer to FIG. 6, which is a sectional view of an interlocking fitness roller when a user disassembles it according to the embodiment of the present invention. When the column-shaped roller bodies 1 are disconnected with the hollow cylindrical assembly 2, the user moves his hand into the hollow interior 11 of the second column-shaped roller body 1 to press the handle part 27 connected with the elastic piece 24 of the hollow cylindrical assembly 2. At this time, the elastic piece 24 is driven by the handle part 27, so the retaining block 25 and the positioning pin 26 on the elastic piece 24 are disengaged from the retaining hole 13 and the locating hole 15 of the two column-shaped roller bodies 1 respectively. Then, the second column-shaped roller body 1 engaged with the retaining block 25 of the hollow cylindrical assembly 2 by the retaining hole 13 is disconnected from the hollow cylindrical assembly 2, first. Next, please refer to FIG. 7 and FIG. 8, the hollow cylindrical assembly 2 is pushed into the hollow interior 11 of the first column-shaped roller body 1, then the user release the press on the handle part 27 for returning the elastic piece 24. At this time, the positioning pin 26 on the hollow cylindrical assembly 2 is inserted into the guide slot 14 to guide the hollow cylindrical assembly 2 into the hollow interior 11 of the first column-shaped roller body 1 for storage. Therefore, the hollow cylindrical assembly 2 does not expose to the outside of the column-shaped roller body 1 and the length of each column-shaped roller body is the same to be convenient to carry and storage. Furthermore, at this time, the retaining block 25 of the elastic piece 24 of the hollow cylindrical assembly 2 is engaged with the retaining hole 13 of the column-shaped roller body 1 to be positioned for preventing the hollow cylindrical assembly 2 from slipping out the hollow interior 11 of the column-shaped roller body 1. Moreover, when the column-shaped roller body 1 is connected with another column-shaped roller body 1 again, the hollow cylindrical assembly 2 is pulled out the hollow interior 11 of the column-shaped roller body 1 for connecting with the another column-shaped roller body 1. Accordingly, the convenience of using the interlocking fitness roller of the present invention is enhanced.

The foregoing embodiments and drawings do not limit the interlocking fitness roller of the present invention. The interlocking fitness roller of the present invention could be connected together by several different connect methods. By the first connect method, one end of one column-shaped roller body 1 is assembled with a hollow cylindrical assembly 2, first; then another column-shaped roller body 1 is engaged with the hollow cylindrical assembly 2. By the second connect method, one end of each column-shaped roller body 1 is connected with a hollow cylindrical assembly 2 previously; and when the column-shaped roller bodies 1 are connected with one another, the other end of the column-shaped roller body 1 is engaged with the hollow cylindrical assembly 2 which has connected with another column-shaped roller body 1. By the third connect method, the both ends of a column-shaped roller body 1 are assembled with a hollow cylindrical assembly 2, individually; and then the other two column-shaped roller bodies 1 are engaged with the hollow cylindrical assemblies 2 connected with the both ends of the original column-shaped roller body 1. When the column-shaped roller body 1 is unused, the two hollow cylindrical assemblies 2 are stored into the hollow interior 11 of the column-shaped roller body 1 to decrease the whole volume for easy carrying and storage.

What is claimed is:

1. An interlocking fitness roller, comprising:

a column-shaped roller body, including:

a hollow interior;

a plurality of retaining holes, at least located at one end of the column-shaped roller body; and at least one locating hole, close to a respective one of the plurality of retaining holes;

a hollow cylindrical assembly, inserted into the hollow interior of the column-shaped roller body;

a plurality of elastic pieces, one end of each elastic piece connected with the hollow cylindrical assembly and the other end of each elastic piece connected with a handle part, wherein each elastic piece comprising:

a retaining block, located on the one end of the elastic piece and for engaging with one of the plurality of retaining holes on the column-shaped roller body; and at least one positioning pin, located on the other, end of the elastic piece and for engaging with the at least one locating hole on the column-shaped roller body; and a pad, covering a surface of the column-shaped roller body.

2. The interlocking fitness roller according to claim 1, wherein the column-shaped roller body includes:

at least two retaining holes, each retaining hole of the at least two retaining holes located at an end of the column-shaped roller body; and at least two locating holes, each locating hole of the at least two locating holes located at an end of the column-shaped roller body.

3. The interlocking fitness roller according to claim 1, wherein each elastic piece includes two positioning pins, each positioning pin of the two positioning pins located at a side of the retaining block.

4. The interlocking fitness roller according to claim 1, further comprising at least one guiding slot, next to one of the plurality of retaining holes on the column-shaped roller body and corresponded with the at least one locating hole.

5. The interlocking fitness roller according to claim 4, wherein the column-shaped roller body includes:

two guiding slots, each guiding slot of the two guiding slots located at a side of one of the plurality of retaining holes; and two locating holes, each locating hole of the two locating holes located at a side of one of the plurality of retaining holes.

6. The interlocking fitness roller according to claim 4, wherein both ends of the column-shaped roller body respectively include at least one set of the plurality of retaining holes, the at least one locating hole, and the at least one guiding slot.

7. The interlocking fitness roller according to claim 4, the column-shaped roller body further comprising:

a dented part, formed on an external wall, in which one of the plurality of retaining holes, the at least one locating hole, and the at least one guiding slot are located, and a cover, covering the dented part.

8. The interlocking fitness roller according to claim 1, each elastic piece further including an abutting block on the handle part.

9. The interlocking fitness roller according to claim 1, further comprising:

a plurality of sliding chutes, axially located on a wall of the hollow interior of the column-shaped roller body; and a plurality of sliders, axially located on an external wall of the hollow cylindrical assembly and corresponded with the plurality of sliding chutes.

10. The interlocking fitness roller according to claim 1, further comprising two trenches, axially extending from one end of the hollow cylindrical assembly, wherein one of the plurality of elastic pieces is formed between the two trenches and only one end of the elastic piece is connected with the hollow cylindrical assembly.

* * * * *